US007281951B2

(12) United States Patent
Aoki

(10) Patent No.: US 7,281,951 B2
(45) Date of Patent: Oct. 16, 2007

(54) CONNECTOR AND MEMORY CARD

(75) Inventor: Yoshitaka Aoki, Kanagawa (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 11/286,202

(22) Filed: Nov. 23, 2005

(65) Prior Publication Data

US 2006/0134986 A1 Jun. 22, 2006

(30) Foreign Application Priority Data

Nov. 26, 2004 (JP) ..... P2004-342531

(51) Int. Cl.
*H01R 24/00* (2006.01)

(52) U.S. Cl. ..... 439/630

(58) Field of Classification Search ..... 439/630, 439/924.1

See application file for complete search history.

(56) References Cited

U.S. PATENT DOCUMENTS 6,527,590 B2 * 3/2003 Oguchi ..... 439/630
6,685,512 B2 * 2/2004 Ooya ..... 439/630

FOREIGN PATENT DOCUMENTS

JP 2002-124343 A 4/2002

* cited by examiner

*Primary Examiner*—Neil Abrams
(74) *Attorney, Agent, or Firm*—Lerner, David, Littenberg, Krumholz & Mentlik, LLP

(57) ABSTRACT

A connector includes a housing for receiving a memory card in an inserted position; a mouth at one end of the housing for inserting the memory card into the housing and for removing the memory card from the housing, the insertion and removal being performed in a longitudinal direction of the housing; and a plurality of connection terminals arranged in the housing in a direction orthogonal to the longitudinal direction and positioned to contact a plurality of contact pieces of a memory card in the inserted position, the plurality of connection terminals including at least one connection terminal for grounding, the connection terminal for grounding having a first contact part and a second contact part operable to contact a contact piece of the memory card for grounding of the memory card in the inserted position, the first contact part being positioned closer to the mouth than the second contact part and closer to the mouth than contact parts of connection terminals other than the connection terminal for grounding. This helps to insure that grounding of the memory card circuits is retained during card removal until the data signals are first disconnected.

11 Claims, 10 Drawing Sheets

CONNECTOR AND MEMORY CARD

CROSS-REFERENCE TO RELATED APPLICATIONS

The present application claims priority from Japanese Patent Application No. 2004-342531 filed on Nov. 26, 2004, the disclosure of which is hereby incorporated by reference herein.

BACKGROUND OF THE INVENTION

The present invention relates to a connector for a memory card, and the memory card.

A connector is provided into which to insert a memory card having a case housing a part forming a memory, a contact piece area provided at an end part in a direction of insertion of the case into a connector so as to be extended in a direction orthogonal to the inserting direction, and a plurality of contact pieces arranged in the direction orthogonal to the inserting direction and each extended in the inserting direction in the contact piece area.

As such a connector, a connector having a mechanism for inserting and removing a memory card on a so-called push-in push-out basis is proposed in which mechanism, when the memory card is loaded into the connector, the memory card is pushed into the connector (push-in) along an inserting direction, whereby the memory card is locked in a state in which the contact pieces of the memory card are connected to the connection terminals of the connector, and when the memory card is extracted and removed from the connector, the memory card connected to the connector is pushed in the inserting direction, whereby the memory card is unlocked to be removed (push-out) (see for example Japanese Patent Laid-open No. 2002-124343).

That is, supposing that the position in the inserting direction of the memory card in a state in which the memory card is connected to the connector is a normal use position, the memory card is temporarily moved in the inserting direction by a predetermined dimension (for example about 1 mm to 2 mm) from the normal use position when the memory card is loaded into the connector (at the time of a push-in) and when the memory card is removed from the connector (at the time of a push-out). This predetermined dimension is necessary for the mechanism to operate.

The contact pieces of the memory card include contact pieces for transmitting and receiving data signals and contact pieces for grounding. The connection terminals of the connector include connection terminals for transmitting and receiving the data signals which connection terminals contact the contact pieces for transmitting and receiving the data signals, and connection terminals for grounding which connection terminals contact the contact pieces for grounding.

In order to prevent electrostatic noise from entering a signal line of the memory card and producing an adverse effect on the memory card, when the memory card is inserted into the connector, it is necessary that the contact pieces of the memory card for grounding be first connected to the connection terminals of the connector for grounding and then the contact pieces of the memory card for transmitting and receiving the data signals be connected to the connection terminals of the connector for transmitting and receiving the data signals. In addition, when the memory card is extracted and removed from the connector, it is necessary that the contact pieces of the memory card for transmitting and receiving the data signals be first disconnected from the connection terminals of the connector for transmitting and receiving the data signals and then the contact pieces of the memory card for grounding be disconnected from the connection terminals of the connector for grounding.

Thus, the connection terminals of the connector for grounding are disposed closer to an inserting mouth than the connection terminals of the connector for transmitting and receiving the data signals in the inserting direction.

In the case where the connection terminals for grounding are disposed closer to the inserting mouth than the connection terminals for transmitting and receiving the data signals in the inserting direction, when the memory card is temporarily moved in the inserting direction by the predetermined dimension from the normal use position at a time of inserting or removing the memory card, the connection terminals for grounding in the connector of the above-described push-in push-out system, for example, come close to a part of the case of the memory card.

At this time, if the connection terminals of the connector for grounding go up on the part of the case of the memory card, for example, due for example to variations in dimensional accuracy of the memory card or the connector, the connection terminals for grounding are separated from the contact pieces for grounding, and thus the memory card is temporarily disconnected from a ground, so that electrostatic noise may produce an adverse effect on the memory card.

In particular, the number of data signals has been increasing with increase in the transfer speed of data sent and received between the memory card and the connector. Accordingly, there are a demand for more contact pieces in a limited space of the memory card, and a demand for more connection terminals in a limited space of the connector. The above-described problem therefore tends to occur.

The present invention has been made in view of such a situation, and it is desirable to provide a connector and a memory card that stably retain a state of connection between contact pieces for grounding and connection terminals for grounding at a time of inserting the memory card into the connector and removing the memory card from the connector, and which are advantageous in stabilizing the operation of the memory card.

SUMMARY OF THE INVENTION

According to an embodiment of the present invention, there is provided a connector including a housing for receiving a memory card in an inserted position; a mouth at one end of the housing for inserting the memory card into the housing and for removing the memory card from the housing, the insertion and removal being performed in a longitudinal direction of the housing; and a plurality of connection terminals arranged in the housing in a direction orthogonal to the longitudinal direction and positioned to contact a plurality of contact pieces of a memory card inserted in the housing in the inserted position, the plurality of connection terminals including at least one connection terminal for grounding, the connection terminal for grounding having a first contact part and a second contact part operable to contact a contact piece of the memory card for grounding of the memory card in the inserted position, the first contact part being positioned closer to the mouth than the second contact part and closer to the mouth than contact parts of connection terminals other than the connection terminal for grounding, the contact parts of the other connection terminals being in contact with contact pieces of the memory card in the inserted position.

According to another embodiment of the present invention, there is provided a combination of a memory card loaded in an inserted position into a connector, the combination including a memory card having a pair of adjacent partition walls and a contact piece disposed between the pair of adjacent partition walls; and a connector having a housing for receiving the memory card in the inserted position, a mouth at one end of the housing for inserting the memory card into the housing and for removing the memory card from the housing, the insertion and removal being performed in a longitudinal direction of the housing, and two connection terminals at spaced positions in the longitudinal direction, the two connection terminals contacting the contact piece of the memory card in the inserted position, wherein the contact piece of the memory card has a length in the longitudinal direction such that the connection terminals do not go beyond the contact piece in the longitudinal direction when the memory card is in the inserted position.

According to the connector of the present invention, even if the first contact part of the connection terminal for grounding goes up on the case of the memory card when the memory card is inserted or removed, the second contact part is retained in contact with the contact piece for grounding, and therefore an internal circuit in the memory card can be surely retained in a state of being connected to a ground via the second contact part.

According to the memory card of the present invention, a state of connection between the contact piece for grounding and the connection terminal for grounding can be surely retained when the memory card is inserted or removed.

In the connector of the present invention, the connection terminal for grounding has a first contact part and a second contact part, and the first contact part is positioned closer to the mouth of the housing than the second contact part.

In the memory card of the present invention, the contact piece of the memory card has a length in the longitudinal direction such that the connection terminal does not go beyond the contact piece in the longitudinal direction.

DETAILED DESCRIPTION

A first embodiment of the present invention will next be described with reference to drawings.

Description will first be made of a memory card loaded into a connector according to an embodiment of the present invention.

Figure 1:
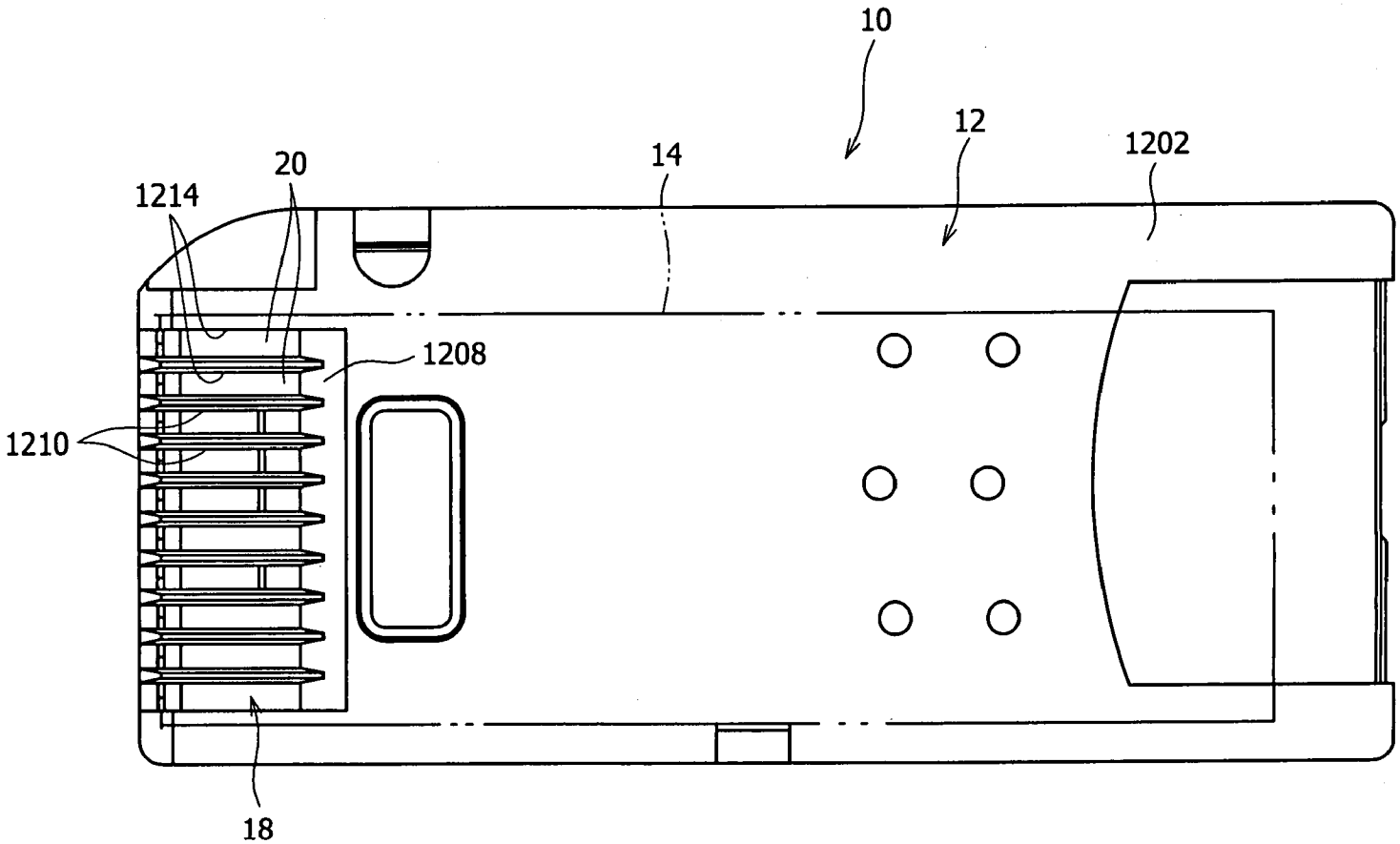
FIG. 1 is a bottom view of a memory card as viewed from below.
Figure 2:
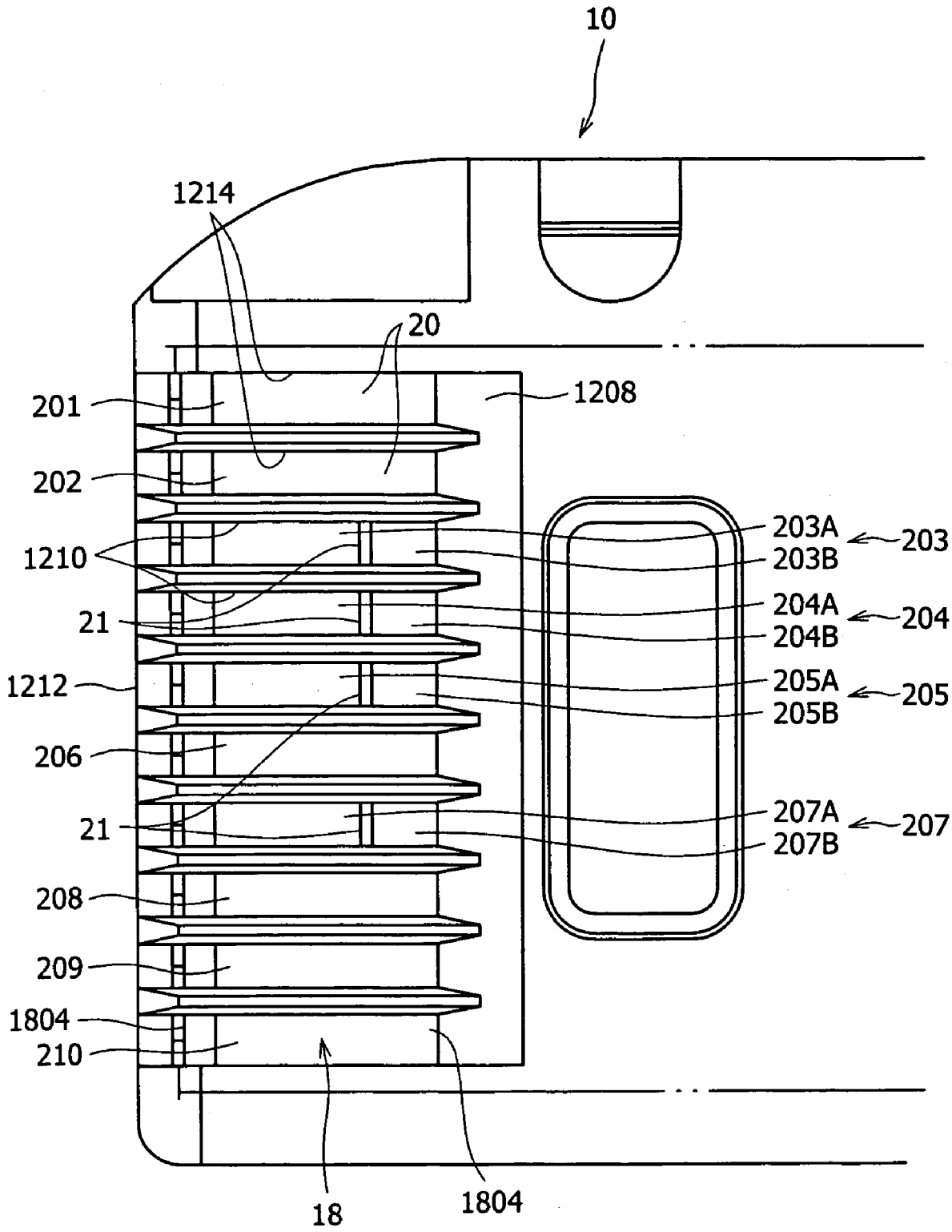
FIG. 2 is an enlarged view of principal parts in FIG. 1.
Figure 3:
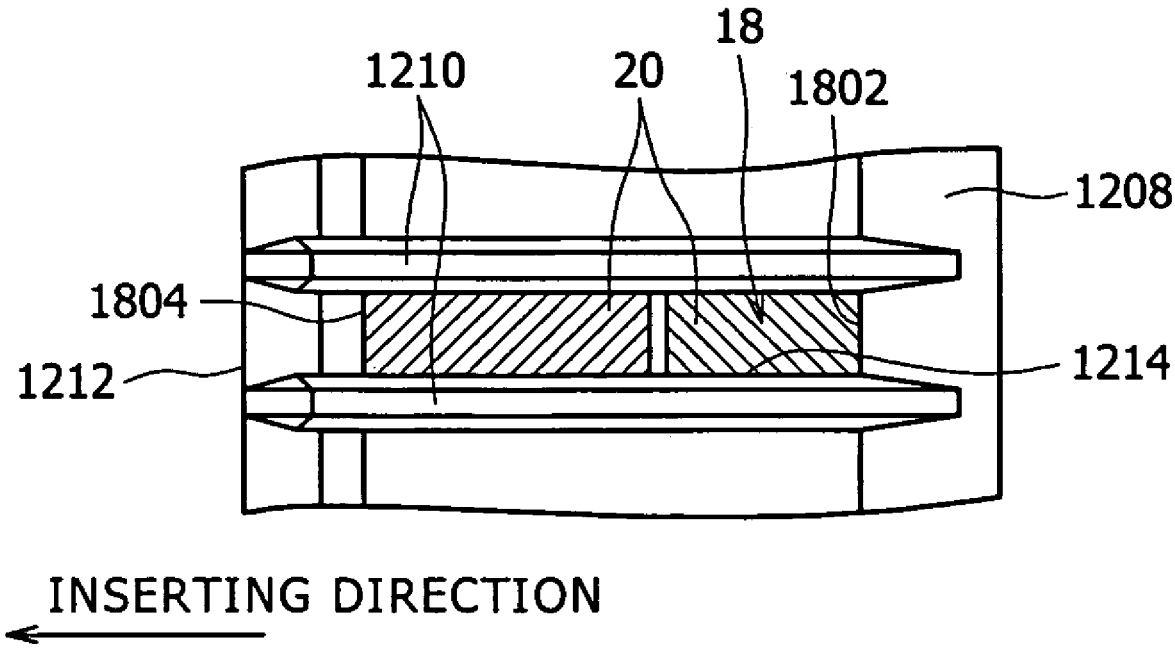
FIG. 3 is a plan view showing a relation between contact pieces of the memory card and contact parts of a connector.
Figure 4:
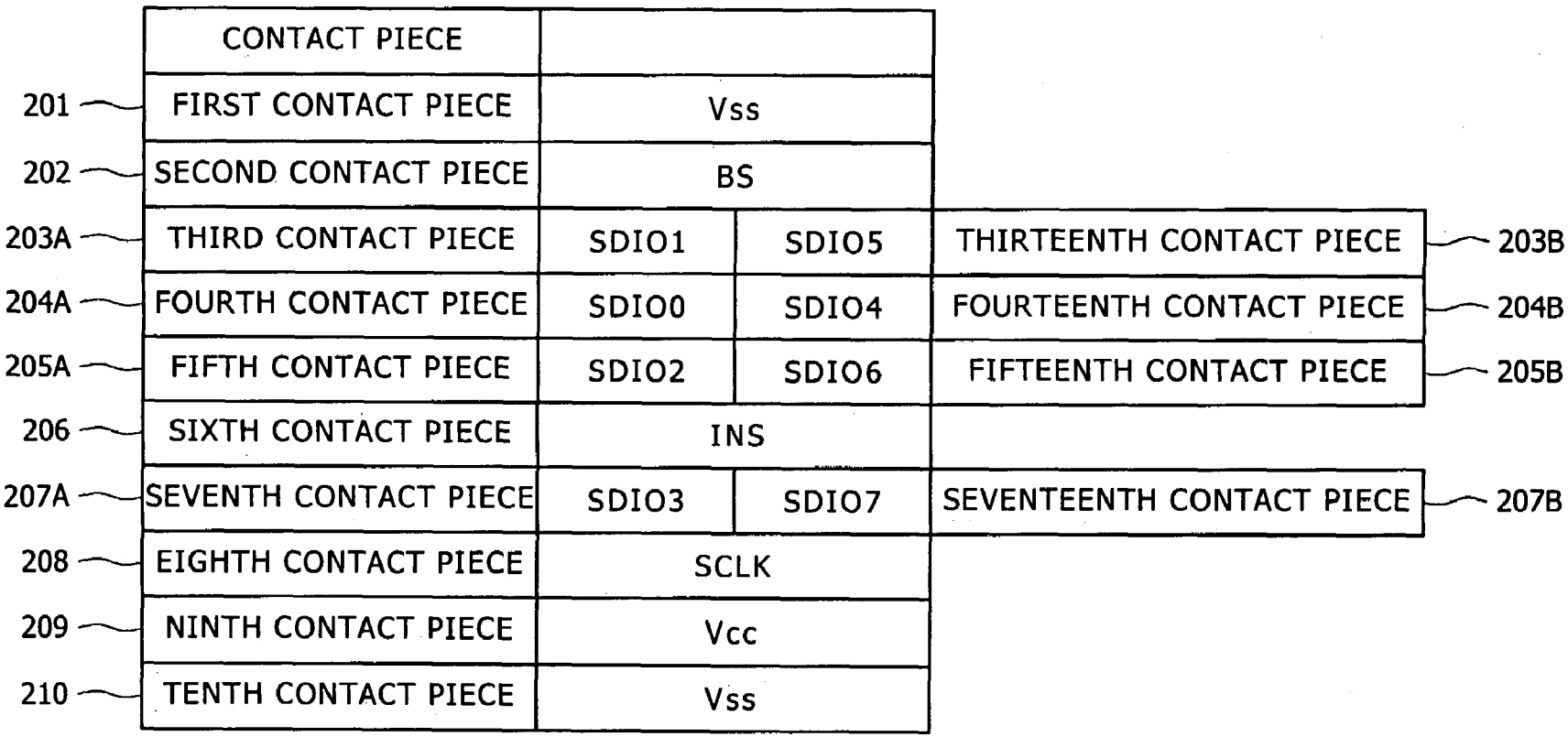
FIG. 4 is a diagram of assistance in explaining signals assigned to the respective contact pieces of the memory card.

FIG. 1 is a bottom view of a memory card 10 as viewed from below. FIG. 2 is an enlarged view of principal parts in FIG. 1. FIG. 3 is a plan view showing a relation between contact pieces 20 of the memory card 10 and contact parts 7202 of a connector 50. FIG. 4 is a diagram of assistance in explaining signals assigned to the respective contact pieces of the memory card 10.

As shown in FIG. 1, the memory card 10 has a case 12 and a printed board 14 housed in an internal space formed by the case 12.

The memory card 10 has a thickness in a vertical direction, a width in a lateral direction which width is greater than the thickness, and a length in a longitudinal direction which length is greater than the width. This longitudinal direction is a direction in which the memory card 10 is inserted into the connector, that is, a direction of insertion of the memory card 10.

The printed board 14 is a part forming a memory. The printed board 14 has for example an insulating board not shown in the figure, a memory chip not shown in the figure mounted on the insulating board, an electronic part not shown in the figure forming a control circuit for, for example, controlling the operation of inputting and outputting data to and from the memory chip, and a switch not shown in the figure for write protection.

At one end in the longitudinal direction of the printed board 14 (an end part in the direction of insertion into the connector), a contact piece area 18 is formed so as to be extended in a direction orthogonal to the longitudinal direction. A plurality of contact pieces 20 to be described later is provided in the contact piece area 18.

A plurality of partition walls 1210 extended in the longitudinal direction is arranged at intervals in a width direction at an end part in the direction of insertion of an undersurface 1202 of the case 12, that is, the undersurface 1202 part of the case 12 under the contact piece area 18. There are openings 1214 extended in the longitudinal direction (direction of insertion) between the partition walls 1210 adjacent to each other.

More specifically, the plurality of partition walls 1210 are each extended from a base part 1802 of the contact piece area 18 to an end part 1804 of the contact piece area 18, and are arranged at intervals in the direction orthogonal to the longitudinal direction (inserting direction).

As shown in FIG. 2 and FIG. 3, the base ends of the plurality of partition walls 1210 are connected to each other by an inclined surface 1208 extended in the width direction. The inclined surface 1208 is connected to the undersurface 1202.

The front end top surfaces of the plurality of partition walls 1210 are connected to each other by a thin connecting wall 1212.

Thus, at the end part in the longitudinal direction of the memory card 10 (the undersurface at the end part in the inserting direction), parts of the contact piece area 18 are shown in the respective openings 1214 between the plurality of partition walls 1210 arranged at intervals in the direction orthogonal to the direction of insertion of the memory card 10 into the connector. These parts of the contact piece area 18 form a plurality of contact pieces 20.

As shown in FIG. 2, the plurality of contact pieces 20 are formed between the plurality of partition walls 1210, arranged in the direction orthogonal to the longitudinal direction of the memory card 10, and each extended in the longitudinal direction.

Specifically, as shown in FIG. 2, the plurality of contact pieces 20 are formed by a first contact piece 201, a second contact piece 202, a third contact piece 203A, a fourth contact piece 204A, a fifth contact piece 205A, a sixth contact piece 206, a seventh contact piece 207A, an eighth contact piece 208, a ninth contact piece 209, a tenth contact piece 210, a thirteenth contact piece 203B, a fourteenth contact piece 204B, a fifteenth contact piece 205B, and a seventeenth contact piece 207B.

Functions assigned to the plurality of contact pieces 20 are as shown in FIG. 4.

The first contact piece 201 and the tenth contact piece 210 are grounding contact pieces connected to a ground level (Vss).

The second contact piece 202 is supplied with a bus state signal BS indicating divisions of data communicated by data signals SDIO0 to SDIO7.

The eighth contact piece 208 is a clock input contact piece supplied with a clock signal SCLK. The bus state signal BS and the data signals SDIO0 to SDIO7 are communicated in synchronism with the clock signal SCLK.

The ninth contact piece 209 is a power input contact piece supplied with power Vcc.

The sixth contact piece 206 is an insertion and extraction detecting contact piece. The sixth contact piece 206 sends and receives an INS signal used for an external device to detect the insertion or extraction of the memory card. Therefore the sixth contact piece 206 is not used for data communication.

The third contact piece 203A, the fourth contact piece 204A, the fifth contact piece 205A, the seventh contact piece 207A, the thirteenth contact piece 203B, the fourteenth contact piece 204B, the fifteenth contact piece 205B, and the seventeenth contact piece 207B are data transmitting and receiving contact pieces that input or output the 8-bit parallel data signals SDIO0 to SDIO7.

Specifically, the third contact piece 203A inputs or outputs the data signal SDIO1. The thirteenth contact piece 203B inputs or outputs the data signal SDIO5.

The fourth contact piece 204A inputs or outputs the data signal SDIO0. The fourteenth contact piece 204B inputs or outputs the data signal SDIO4.

The fifth contact piece 205A inputs or outputs the data signal SDIO2. The fifteenth contact piece 205B inputs or outputs the data signal SDIO6.

The seventh contact piece 207A inputs or outputs the data signal SDIO3. The seventeenth contact piece 207B inputs or outputs the data signal SDIO7.

In the present embodiment, the first contact piece 201, the second contact piece 202, the sixth contact piece 206, and the eighth contact piece 208 to the tenth contact piece 210 are each disposed as a single contact piece between two partition walls 1210 adjacent to each other.

The third contact piece 203A and the thirteenth contact piece 203B are arranged at an interval in an inserting and removing direction between two partition walls 1210 adjacent to each other. Similarly, the fourth contact piece 204A and the fourteenth contact piece 204B, the fifth contact piece 205A and the fifteenth contact piece 205B, and the seventh contact piece 207A and the seventeenth contact piece 207B are arranged at an interval in the inserting and removing direction between two partition walls 1210 adjacent to each other.

The eighth contact piece 208 is a clock input contact piece supplied with a clock signal SCLK. The bus state signal BS and the data signals SDIO0 to SDIO7 are communicated in synchronism with the clock signal SCLK.

The ninth contact piece 209 is a power input contact piece supplied with power Vcc.

The sixth contact piece 206 is an insertion and extraction detecting contact piece. The sixth contact piece 206 sends and receives an INS signal used for an external device to detect the insertion or extraction of the memory card. Therefore the sixth contact piece 206 is not used for data communication.

The connector 50 according to the present embodiment will next be described.

Figure 5:
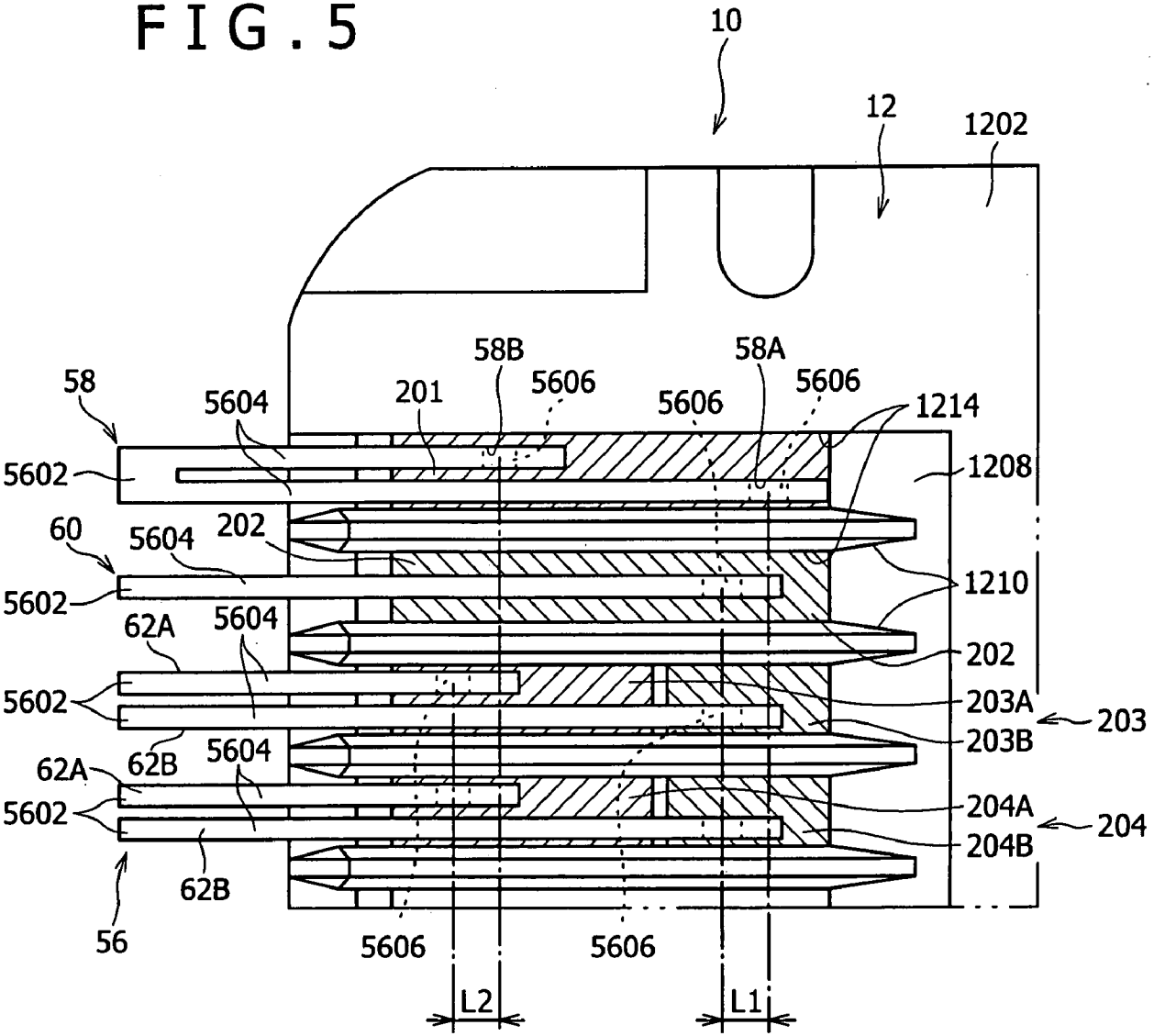
FIG. 5 is a plan view showing a state of the memory card being loaded in the connector.

FIG. 5 is a plan view showing a state of the memory card 10 being loaded in the connector 50.

Figure 6B:
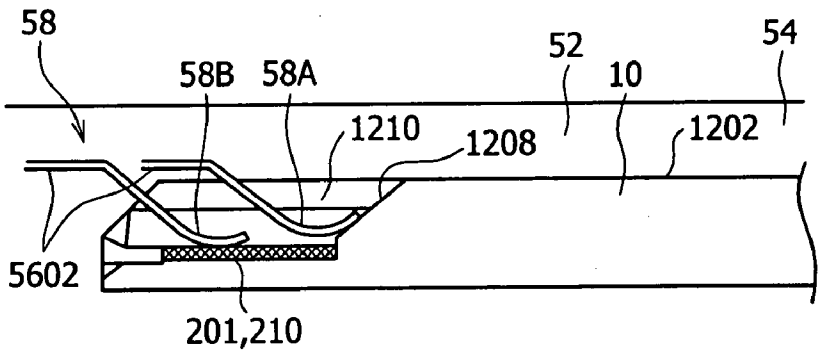
FIGS. 6B and 6D are diagrams of assistance in explaining a state of the memory card being placed at a back end position after being further pushed in an inserting direction from the connection position.
Figure 6A:
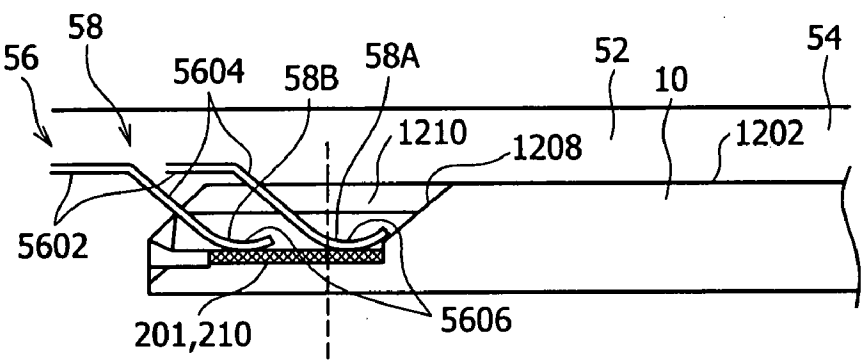
FIGS. 6A and 6C are diagrams of assistance in explaining a state of the memory card being loaded in the connector and placed at a connection position.
Figure 6D:
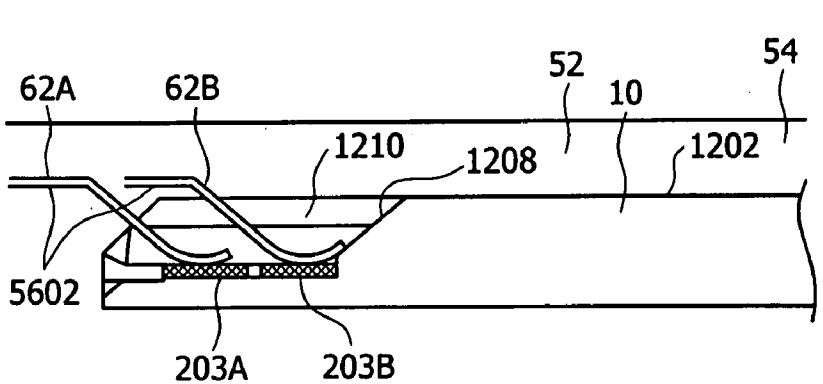
Figure 6C:
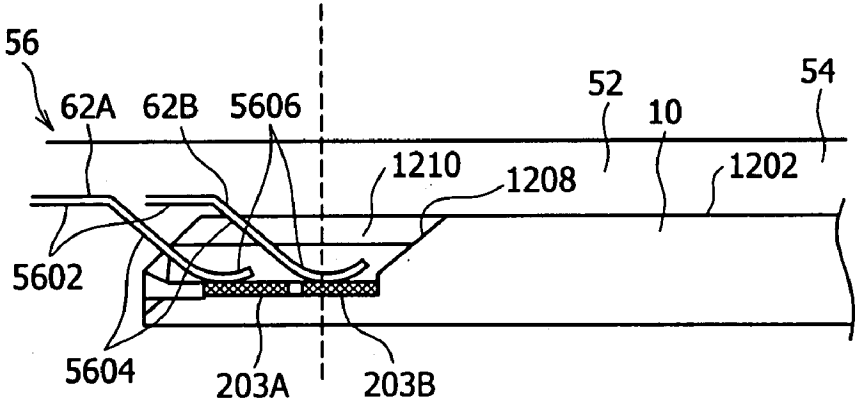

FIGS. 6A and 6C are diagrams of assistance in explaining a state of the memory card 10 being loaded in the connector 50 and placed at a connection position. FIGS. 6B and 6D are diagrams of assistance in explaining a state of the memory card 10 being placed at a back end position after being further pushed in the inserting direction from the connection position.

As shown in FIG. 5, the connector 50 has a memory card housing 52 in which the memory card 10 is housed, an inserting and removing mouth 54 for inserting the memory card 10 into the memory card housing and removing the memory card 10 from the memory card housing, and a plurality of connection terminals 56 provided in the memory card housing 52 so as to be able to contact respectively contact pieces 20 between the plurality of partition walls 1210 of the inserted memory card 10.

The connector 50 in the present embodiment is of the push-in push-out type. The memory card housing 52 is provided with a push-in push-out mechanism.

Description will be made of the push-in push-out mechanism. Supposing that the position in the inserting direction of the memory card 10 in a state of being loaded in the connector 50 is a connection position (FIGS. 6A and 6C), the memory card 10 is configured such that at the time of loading the memory card 10 into the connector 50 (at the time of a push-in), when the memory card 10 is inserted from the inserting and removing mouth 54 into the memory card housing 52, the memory card 10 is pushed in to a back end position (FIGS. 6B and 6D) at a distance of a predetermined dimension (for example about 1 mm to 2 mm) in the inserting direction from the connection position, and then the memory card 10 is released, the memory card 10 is returned to the connection position, and locked at the connection position.

At the time of removing the memory card 10 from the connector 50 (at the time of a push-out), when the memory card 10 is pushed in to the back end position (FIGS. 6B and 6D) again, and is then released, the memory card 10 is unlocked, and projects from the inserting and removing mouth 54 at an extraction position allowing the extraction of the memory card 10.

Incidentally, various conventional structures that are publicly known or well known can be used for such a push-in push-out mechanism (for example Japanese Patent Laid-open No. 2002-124343 and the like).

The plurality of connection terminals 56 are each formed of a terminal member having conductivity and elasticity.

The plurality of connection terminals 56 are 14 connection terminals in total: two connection terminals 58 for grounding, one connection terminal 60 for the bus state signal, eight connection terminals 62 for the data signals (for transmitting and receiving data), one connection terminal (not shown) for the INS signal, one connection terminal (not shown) for the clock signal, and one connection terminal (not shown) for power supply.

Each connection terminal 56 has a base part 5602 attached to the memory card housing 52, an intermediate part 5604 extending in the inserting and removing direction from the base part 5602, and a contact part 5606 formed at an end of the intermediate part 5604 so as to be able to contact a contact piece 20.

In the present embodiment, the base part 5602 is situated close to an opposite side to the inserting and removing mouth 54, and the contact part 5606 is situated closer to the inserting and removing mouth 54 than the base part 5602.

As shown in FIG. 5, the connection terminal 60 for the bus state signal is disposed so as to be able to contact the second contact piece 202 for the bus state signal BS at a position next to the first contact piece 201 for grounding between partition walls 1210 adjacent to each other.

Two connection terminals 62A and 62B for a data signal (for transmitting and receiving data) are disposed so as to be able to contact the contact pieces 203A and 203B between partition walls 1210 adjacent to each other. The contact part 5606 (corresponding to the fourth contact part in the claims) of the connection terminal 62B is displaced to a position closer to the inserting and removing mouth 54 than the contact part 5606 (corresponding to the third contact part in the claims) of the connection terminal 62A.

Similarly, two connection terminals 62A and 62B for a data signal (for transmitting and receiving data) are disposed so as to be able to contact the contact pieces 204A and 204B between partition walls 1210 adjacent to each other.

Similarly, two connection terminals and (not shown) for a data signal (for transmitting and receiving data) are disposed so as to be able to contact the contact pieces 205A and 205B (see FIG. 4) between partition walls 1210 adjacent to each other.

The connection terminal 56 for the INS signal (not shown) is disposed so as to be able to contact the sixth contact piece 206 between partition walls 1210 adjacent to each other.

Two connection terminals and (not shown) for a data signal (for transmitting and receiving data) which terminals are next to the connection terminal 56 for the INS signal are disposed so as to be able to contact the contact pieces 207A and 207B (see FIG. 4) between partition walls 1210 adjacent to each other.

The connection terminal 56 for the clock signal (not shown) is disposed so as to be able to contact the eighth contact piece 208 as a clock input contact piece between partition walls 1210 adjacent to each other.

The connection terminal 56 for power supply (not shown) is disposed so as to be able to contact the ninth contact piece 209 as a power input contact piece between partition walls 1210 adjacent to each other.

As shown in FIG. 5, one of the two connection terminals 58 for grounding has a first contact part 58A and a second contact part 58B that can contact the first contact piece 201 as a contact piece for grounding the memory card 10. Though not shown in this figure, the other connection terminal 58 for grounding also has a first contact part 58A and a second contact part 58B that can contact the tenth contact piece 210 as a contact piece for grounding the memory card 10.

The first contact part 58A is displaced in the direction of the inserting and removing mouth 54 in the direction of insertion and removal of the memory card 10 with respect to the second contact part 58B.

In addition, the first contact part 58A is displaced in the direction of the inserting and removing mouth 54 in the direction of insertion and removal of the memory card 10 with respect to the contact parts of the other connection terminals 56 than the two connection terminals 58 for grounding, the contact parts of the other connection terminals being in contact with contact pieces of the memory card 10.

In the present embodiment, as shown in FIG. 5, the first contact part 58A is displaced in the direction of insertion and removal of the memory card 10 with respect to the contact part 5606 of the connection terminal 60 for the bus state signal, the contact parts 5606 of the connection terminals 62B for data signals, the contact part 5606 of the connection terminal for the INS signal, the contact part 5606 of the connection terminal for the clock signal, and the contact part 5606 of the connection terminal for power supply. Specifically, the first contact part 58A is displaced in the direction of the inserting and removing mouth 54 by a dimension L1 with respect to the contact part 5606 of the connection terminal 60 for the bus state signal, the contact part 5606 of the connection terminal for the INS signal, the contact part 5606 of the connection terminal for the clock signal, and the contact part 5606 of the connection terminal for power supply.

The second contact part 58B is displaced to the opposite side to the inserting and removing mouth 54 for inserting and removing the memory card 10 with respect to the contact part 5606 of the connection terminal 60 for the bus state signal, the contact parts 5606 of the connection terminals 62A for data signals, the contact part 5606 of the connection terminal for the INS signal, the contact part 5606 of the connection terminal for the clock signal, and the contact part 5606 of the connection terminal for power supply. Specifically, the second contact part 58B is displaced in the direction of the inserting and removing mouth 54 by a dimension L2 with respect to the contact parts 5606 of the connection terminals 62A for data signals (for transmitting and receiving data).

In the present embodiment, the first contact part 58A and the second contact part 58B are arranged at an interval in the direction of insertion and removal of the memory card 10 and at different positions in the direction orthogonal to the direction of insertion and removal of the memory card 10, and the first contact part 58A and the second contact part 58B are disposed in a single connection terminal 58.

In the present embodiment, the connection terminal 58 for grounding is formed by a single terminal forming member. The terminal forming member has a single base part 5602, intermediate parts 5604 that are at an interval in the direction orthogonal to the direction of insertion and removal of the memory card 10 and are extended from the base part 5602 in parallel with each other, and contact parts 5606 (the first contact part 58A and the second contact part 58B) formed at ends of the intermediate parts 5604.

In the present embodiment, as shown in FIGS. 6A to 6D, the first contact part 58A and the second contact part 58B are formed so as to be curved or bent in a convex manner facing the first contact piece 201 or the tenth contact piece 210 for grounding the memory card 10.

Effects will next be described.

Description will first be made of an operation of loading the memory card 10 into the connector 50.

When the memory card 10 is inserted and pushed into the memory card housing 52 of the connector 50, the first contact parts 58A of the two connection terminals 58 for grounding contact the first contact piece 201 and the tenth contact piece 210 for grounding prior to the other connection terminals 56 than the connection terminals 58 for grounding, as shown in FIG. 5 and FIGS. 6A and 6C, because the first contact parts 58A of the two connection terminals 58 for grounding are disposed in the direction of the inserting and removing mouth 54 in the direction of insertion and removal of the memory card 10 with respect to the contact parts of the other connection terminals 56 than the two connection terminals 58 for grounding at which contact parts of the other connection terminals 56 contact the contact pieces of the memory card 10. An internal circuit in the memory card 10 is thereby connected to a ground via the first contact parts 58A of the connection terminals 58 for grounding.

By further pushing in the memory card 10, the other connection terminals 56 than the connection terminals 58 for grounding contact the respective contact pieces 20 (the second to ninth contact pieces 202 to 209), and in addition to the first contact parts 58A of the connection terminals 58 for grounding, the second contact parts 58B contact the first contact piece 201 and the tenth contact piece 210 for grounding.

When the memory card 10 is pushed in past the connection position to the back end position, and is then released after being pushed in to the back end position, the memory card 10 is returned to the connection position shown in FIGS. 6A and 6C. Both the first contact parts 58A and the second contact parts 58B of the connection terminals 58 for grounding come into contact with the first contact piece 201 and the tenth contact piece 210 for grounding as with the other connection terminals 56. The memory card 10 is locked at the connection position.

Description will next be made of an operation of removing the memory card 10 from the connector 50.

When the memory card 10 at the connection position is pushed in to the back end position and then released, the memory card 10 is unlocked, and the memory card 10 passes the connection position to project from the inserting and removing mouth 54 and be moved to an extraction position. At this time, the other connection terminals 56 than the connection terminals 58 for grounding go out of contact with the respective contact pieces 20 before the first contact parts 58A of the connection terminals 58 for grounding go out of contact with the first contact piece 201 and the tenth contact piece 210 for grounding because the first contact parts 58A of the two connection terminals 58 for grounding are displaced in the direction of the inserting and removing mouth 54 in the direction of insertion and removal of the memory card 10 with respect to the contact parts of the other connection terminals 56 than the two connection terminals 58 for grounding, the contact parts of the other connection terminals being in contact with contact pieces of the memory card 10.

That is, the other connection terminals 56 than the connection terminals 58 for grounding go out of contact with the respective contact pieces 20 before the internal circuit in the memory card 10 is disconnected from the ground by the first contact parts 58A of the connection terminals 58 for grounding.

In the connector 50 according to the present embodiment, the connection terminal for grounding is formed by the first contact part and the second contact part that can contact the contact piece for grounding of the memory card and are arranged at an interval in the direction of insertion and removal of the memory card, and the first contact part is displaced in the direction of the inserting and removing mouth in the direction of insertion and removal of the memory card with respect to the contact parts of the other connection terminals than the connection terminal for grounding, the contact parts of the other connection terminals being in contact with contact pieces of the memory card. Therefore, the connection terminal for grounding can be brought into contact with the contact piece prior to the other connection terminals, and can be separated last from the contact piece.

It is therefore possible to surely prevent adverse effects produced when the internal circuit in the memory card 10 is temporarily disconnected from the ground and thereby electrostatic noise or the like enters the internal circuit in the memory card 10 from the other connection terminals 56 than the connection terminals 58 for grounding via the contact pieces 20. This is advantageous in stabilizing the operation of the memory card 10.

The connection terminals 58 for grounding contact the contact pieces (the first contact piece 201 and the tenth contact piece 210) for grounding via the two contact parts, that is, the first contact part 58A and the second contact part 58B. Hence, even if the first contact parts 58A of the connection terminals 58 for grounding come into contact with the slope 1208 of the case 12 of the memory card 10 and go up the slope 1208 as shown in FIGS. 6B and 6D when the memory card 10 is moved from the connection position to the back end position at the time of loading the memory card 10, the second contact parts 58B are retained in contact with the first contact piece 201 and the tenth contact piece 210 for grounding, and therefore the internal circuit in the memory card 10 can be surely retained in a state of being connected to the ground via the second contact parts 58B of the connection terminals 58 for grounding.

Similarly, even if the first contact parts 58A of the connection terminals 58 for grounding come into contact with the slope 1208 of the case 12 of the memory card 10 and go up the slope 1208 as shown in FIGS. 6B and 6D when the memory card 10 at the connection position is moved to the back end position at the time of removing the memory card 10, the second contact parts 58B of the connection terminals 58 for grounding are retained in contact with the first contact piece 201 and the tenth contact piece 210 for grounding, and therefore the internal circuit in the memory card 10 can be surely retained in a state of being connected to the ground via the second contact parts 58B of the connection terminals 58 for grounding.

Thereby, contact resistance can be reduced, and thus the quality of signals sent and received between the memory card 10 and the connector 50 can be improved, which is advantageous in increasing the speed of the signals.

The present invention is particularly effective in maintaining the contact state of the connection terminals 58 for grounding because the contact parts of the connection terminals 58 for grounding become closer to the inserting and removing mouth 54 and thus the connection terminals 58 for grounding tend to go up the slope 1208 of the case 12 at the back end position when two connection terminals for data signals are disposed at an interval in the direction of insertion and removal of the memory card 10 between partition walls 1210 adjacent to each other as in the present embodiment, as compared with a connector in which a single connection terminal is disposed between partition walls 1210 adjacent to each other.

It is to be noted that while in the present embodiment, description has been made of a case where the first contact part 58A and the second contact part 58B are disposed at different positions in the direction orthogonal to the direction of insertion and removal of the memory card 10, the first contact part 58A and the second contact part 58B may be arranged on an identical virtual straight line extended in the direction of insertion and removal of the memory card 10.

In addition, while in the present embodiment, description has been made of a case where the first contact part 58A and the second contact part 58B are formed by a single terminal forming member, the first contact part 58A and the second contact part 58B may be formed by separate terminal forming members.

Further, the length of the openings and the length of the contact pieces 20 of the memory card 10 along the direction of insertion and removal of the memory card 10 may be increased in order to prevent the first contact parts 58A of the connection terminals 58 for grounding from coming into contact with the slope 1208 of the case 12 of the memory card 10 and going up the slope 1208 when the memory card 10 is moved from the connection position to the back end position at the time of loading and removing the memory card 10. That is, the length along the inserting and removing direction of the contact pieces 20 of the memory card 10 may be set such that each connection terminal 56 does not go beyond the contact piece 20 in the inserting and removing direction when the memory card 10 is loaded into the connector 50.

Further, the connector 50 may be provided at an end of a cord, or provided to a device, for example: the connector 50 is used for arbitrary purposes.

A connector according to a conventional example will next be described as an example for comparison with the connector 50 according to the embodiment of the present invention.

Figure 7B:
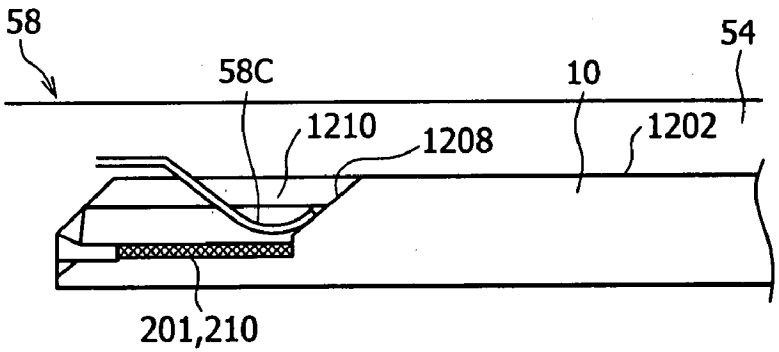
FIGS. 7B and 7D are diagrams of assistance in explaining a state of the memory card being placed at a back end position after being further pushed in the inserting direction from the connection position.
Figure 7A:
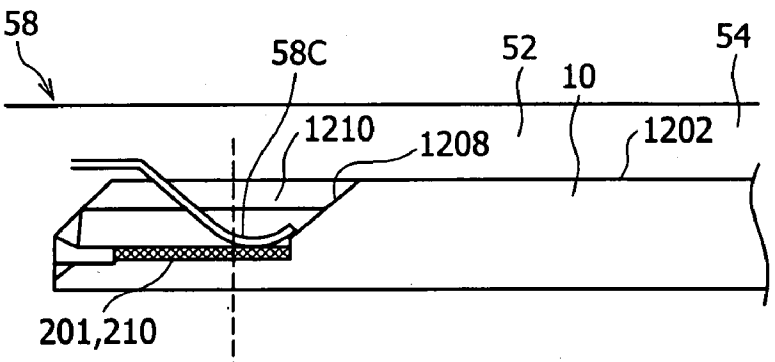
FIGS. 7A and 7C are diagrams of assistance in explaining a state of a memory card being loaded in a connector according to a conventional example and placed at a connection position.
Figure 7D:
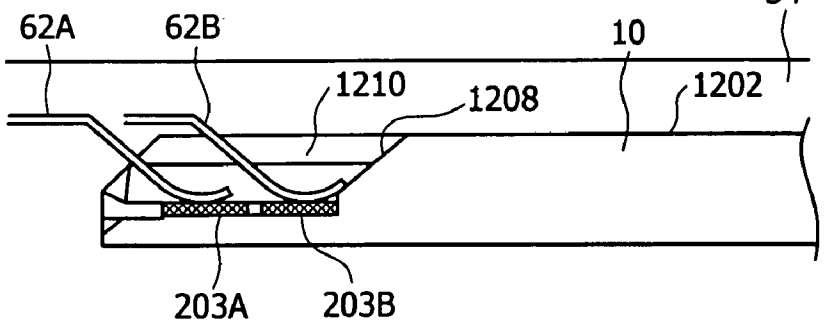
Figure 7C:
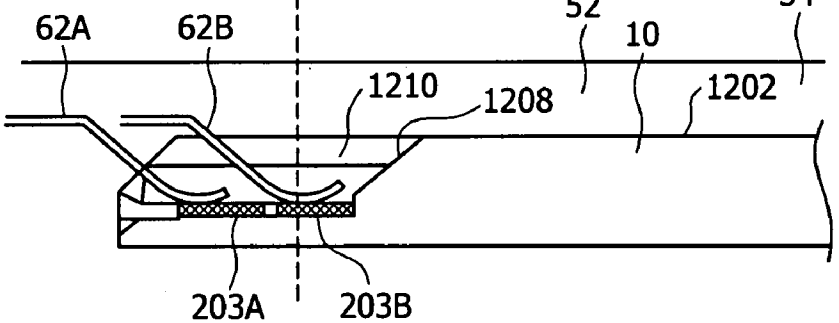

FIGS. 7A and 7C are diagrams of assistance in explaining a state of a memory card 10 being loaded in a connector 50A according to a conventional example and placed at a connection position. FIGS. 7B and 7D are diagrams of assistance in explaining a state of the memory card 10 being placed at a back end position after being further pushed in the inserting direction from the connection position.

As shown in FIG. 7A, the connector 50A according to the conventional example is different from the connector 50 according to the embodiment in that connection terminals 58 for grounding of the connector 50A have only a single contact part 58C. The connector 50A according to the conventional example is substantially similar to the connector 50 according to the embodiment in other respects.

Hence, depending on the structure of other connection terminals, when the memory card 10 is positioned at the back end position, the contact parts 58C of the connection terminals 58 for grounding come into contact with a slope 1208 of a case 12 of the memory card 10 and go up the slope 1208 as shown in FIG. 7B. Thus the contact parts 58C may be temporarily out of contact with a first contact piece 201 and a tenth contact piece 210 for grounding.

Hence, in the case of the conventional example, adverse effects may be produced when an internal circuit in the memory card 10 is temporarily disconnected from a ground and thereby electrostatic noise or the like enters the internal circuit in the memory card 10 from other connection terminals 56 than the connection terminals 58 for grounding via contact pieces 20. The present embodiment, however, can surely avoid such an inconvenience.

In particular, the number of data signals has been increasing with increase in the transfer speed of data sent and received between the memory card 10 and the connector 50. Accordingly, in the present embodiment, the third contact piece 203A and the thirteenth contact piece 203B as data signal inputting and outputting contact pieces of the memory card 10 are arranged at an interval in the inserting and removing direction between two partition walls 1210 adjacent to each other. Similarly, the fourth contact piece 204A and the fourteenth contact piece 204B, the fifth contact piece 205A and the fifteenth contact piece 205B, and the seventh contact piece 207A and the seventeenth contact piece 207B are arranged at an interval in the inserting and removing direction between two partition walls 1210 adjacent to each other. Thereby 8-bit data can be input and output.

Thus, connection terminals 62 for data signals (for transmitting and receiving data) are provided at two positions at an interval in the direction of insertion and removal of the memory card 10 so as to correspond to the third contact piece 203A and the thirteenth contact piece 203B, the fourth contact piece 204A and the fourteenth contact piece 204B, the fifth contact piece 205A and the fifteenth contact piece 205B, and the seventh contact piece 207A and the seventeenth contact piece 207B. A margin of space in the direction of insertion and removal of the memory card 10 is therefore reduced.

Hence, an inconvenience as described above occurs if the connection terminals for grounding are disposed in the space of the reduced margin in the inserting and removing direction so that the single connection terminal for grounding comes into contact with the contact piece for grounding before the other connection terminals than the connection terminals for grounding come into contact with the corresponding contact pieces 20 of the memory card 10 when the memory card 10 is loaded into the connector 50. The present embodiment, however, can effectively prevent such an inconvenience.

A second embodiment of the present invention will next be described with reference to drawings.

Figure 8A:
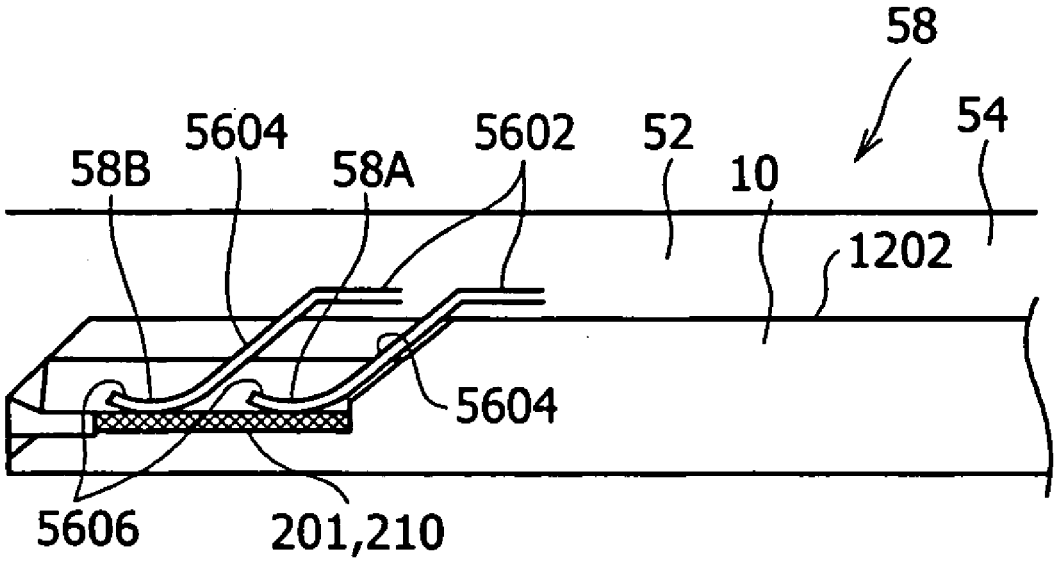
FIGS. 8A and 8B are diagrams of assistance in explaining a state of a memory card being loaded in a connector according to a second embodiment and placed at a connection position.
Figure 8B:
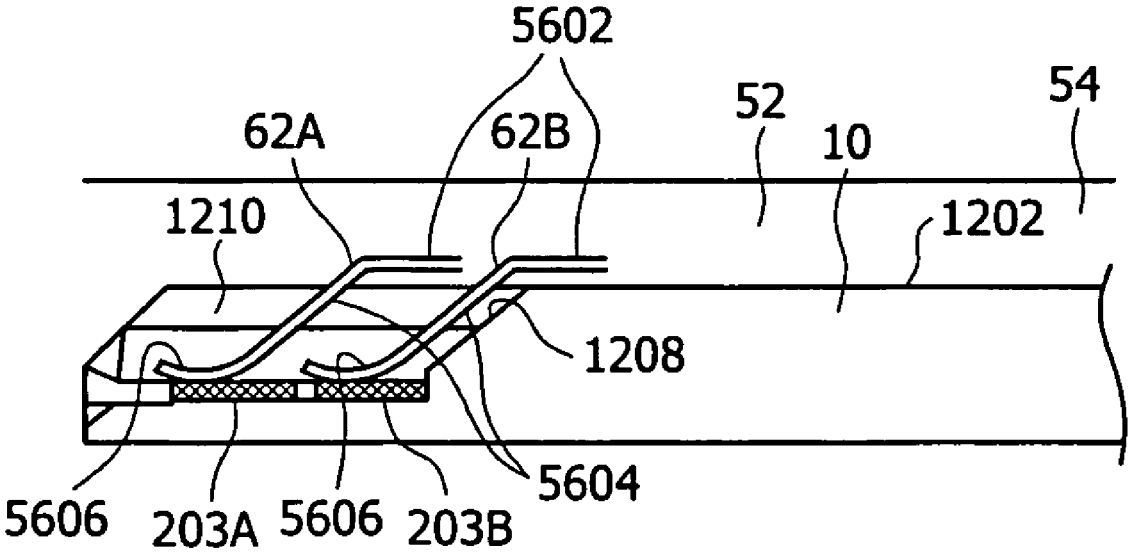

FIGS. 8A and 8B are diagrams of assistance in explaining a state of a memory card 10 being loaded in a connector 50 according to the second embodiment and placed at a connection position.

The second embodiment is a modification of the first embodiment. The second embodiment differs from the first embodiment in that two connection terminals 58 for grounding and eight connection terminals 62 for data signals in the second embodiment are incorporated and retained in a memory card housing 52 such that the base parts 5602 of the two connection terminals 58 for grounding and the eight connection terminals 62 for the data signals are positioned closer to an inserting and removing mouth 54 than contact parts, as shown in FIGS. 8A and 8B, whereas the two connection terminals 58 for grounding and the eight connection terminals 62 for the data signals in the first embodiment are incorporated and retained in the memory card housing 52 such that the base parts 5602 of the two connection terminals 58 for grounding and the eight connection terminals 62 for the data signals are positioned closer to the opposite side to the inserting and removing mouth 54 than the contact parts. The second embodiment is similar to the first embodiment in other respects.

Such a second embodiment can provide similar effects to those of the first embodiment.

A third embodiment of the present invention will next be described with reference to drawings.

Figure 9A:
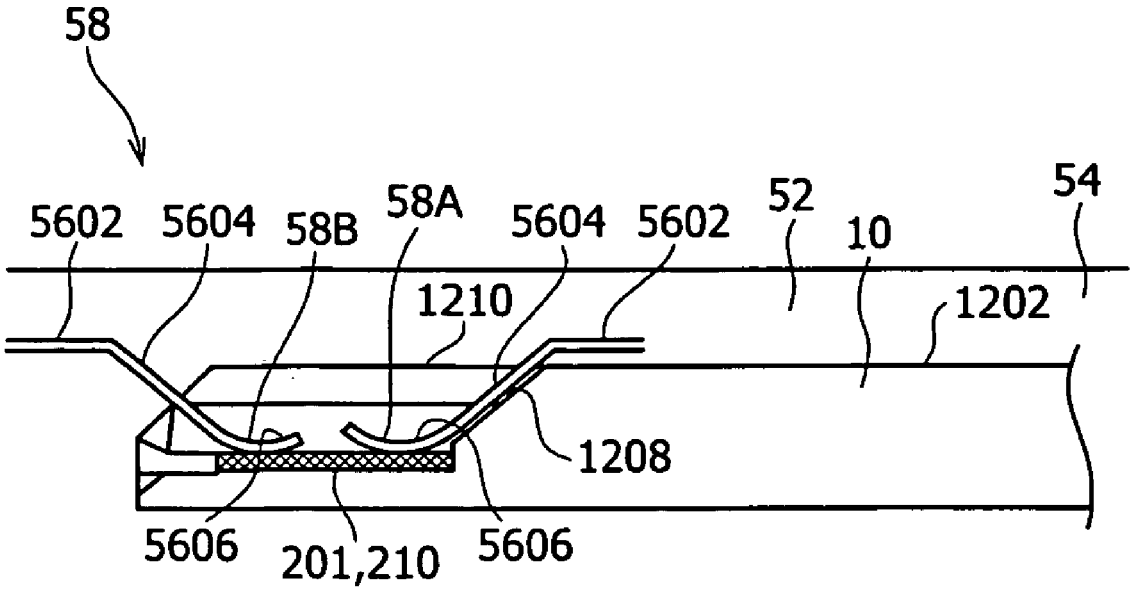
FIGS. 9A and 9B are diagrams of assistance in explaining a state of a memory card being loaded in a connector according to a third embodiment and placed at a connection position.
Figure 9B:
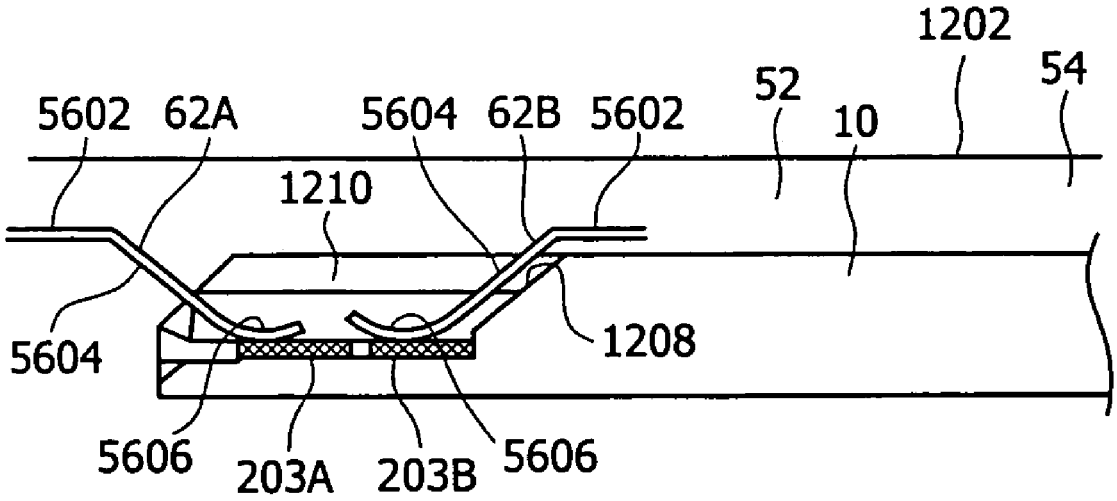

FIGS. 9A and 9B are diagrams of assistance in explaining a state of a memory card 10 being loaded in a connector 50 according to the third embodiment and placed at a connection position.

The third embodiment is a modification of the first embodiment. The third embodiment differs from the first embodiment in that two connection terminals 58 for grounding and eight connection terminals 62 for data signals in the third embodiment are incorporated and retained in a memory card housing 52 such that the base part 5602 of one connection terminal of the two connection terminals 58 for grounding and the eight connection terminals 62 for the data signals is positioned closer to an opposite side to an inserting and removing mouth 54 than a contact part of the connection terminal, and the base part 5602 of another connection terminal of the two connection terminals 58 for grounding and the eight connection terminals 62 for the data signals is positioned closer to the inserting and removing mouth 54 than a contact part of the connection terminal, as shown in FIGS. 9A and 9B, whereas the two connection terminals 58 for grounding and the eight connection terminals 62 for the data signals in the first embodiment are incorporated and retained in the memory card housing 52 such that the base parts 5602 of the two connection terminals 58 for grounding and the eight connection terminals 62 for the data signals are positioned closer to the opposite side to the inserting and removing mouth 54 than the contact parts. The third embodiment is similar to the first embodiment in other respects.

Such a third embodiment can provide similar effects to those of the first embodiment.

Figure 10:
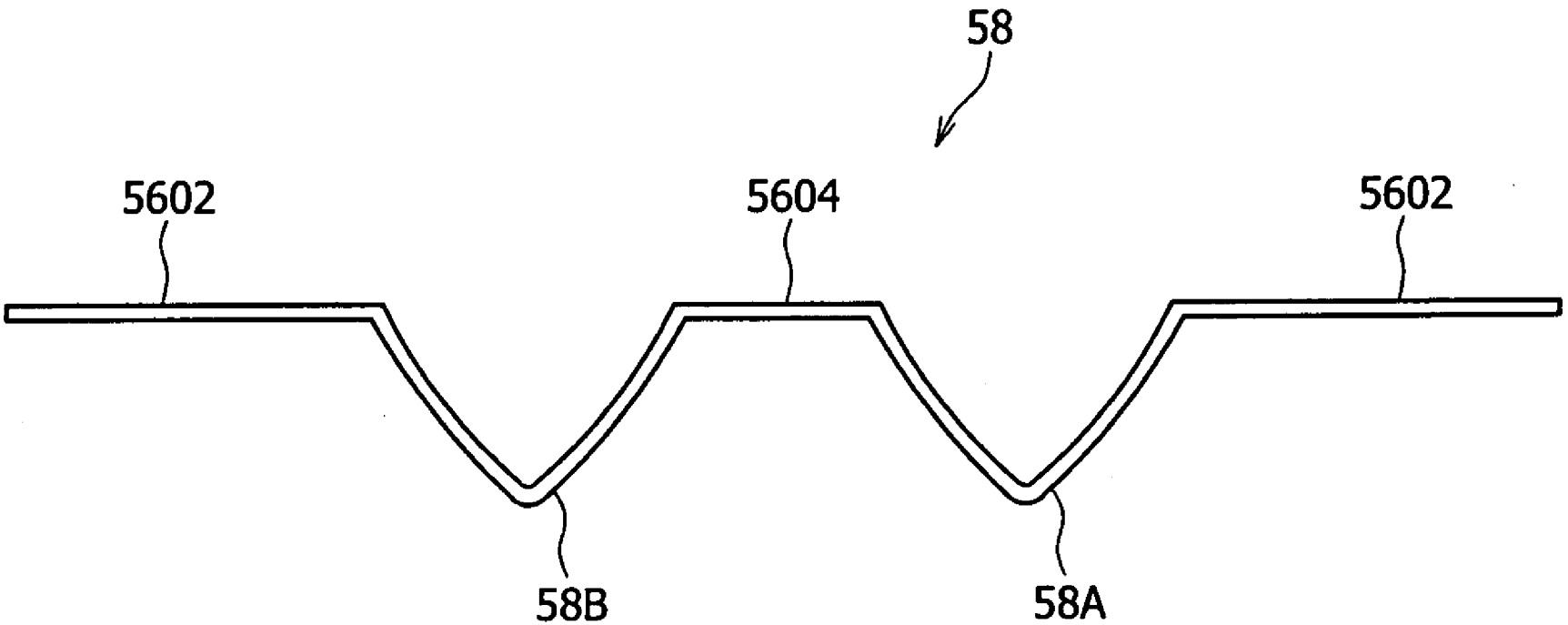
FIG. 10 is a diagram of assistance in explaining a modification of a connection terminal for grounding.

Various structures are conceivable for a connection terminal 58 for grounding including contact parts. For example, as shown in FIG. 10, with both ends in an extending direction of a single terminal forming member formed as base parts, a first contact part 58A and a second contact part 58B may be provided in an intermediate part between the base parts.

It should be understood by those skilled in the art that various modifications, combinations, sub-combinations and alterations may occur depending on design requirements and other factors insofar as they are within the scope of the appended claims or the equivalents thereof.

I claim:

1. A connector, comprising:

a housing for receiving a memory card in an inserted position;

a mouth at one end of the housing for inserting the memory card into the housing and for removing the memory card from the housing, the insertion and removal being performed in a longitudinal direction of the housing; and a plurality of connection terminals arranged in the housing in a direction orthogonal to the longitudinal direction and positioned to contact a plurality of contact pieces of a memory card inserted in the housing in the inserted position, the plurality of connection terminals including at least one connection terminal for grounding, the connection terminal for grounding having a first contact part and a second contact part operable to contact a contact piece of the memory card for grounding of the memory card in the inserted position, the first contact part being positioned closer to the mouth than the second contact part and closer to the mouth than contact parts of connection terminals other than the connection terminal for grounding, the contact parts of the other connection terminals being in contact with contact pieces of the memory card in the inserted position;

at least one of the connection terminals being operable to contact at least two of the contact pieces which are arranged so that they are in tandem along the longitudinal direction of the housing when the memory card is inserted in the housing.

2. The connector as claimed in claim 1, wherein the first contact part and the second contact part are arranged on an identical virtual straight line extending in the longitudinal direction.

3. The connector as claimed in claim 1, wherein the first contact part and the second contact part are arranged at different positions in the direction orthogonal to the longitudinal direction.

4. The connector as claimed in claim 1, wherein the connection terminals are formed by a terminal member having conductivity and elasticity, and the first contact part and the second contact part are disposed in a single terminal member.

5. The connector as claimed in claim 1, wherein the connection terminals are formed by a terminal member having conductivity and elasticity, and the first contact part and the second contact part are disposed in separate terminal members.

6. The connector as claimed in claim 1, wherein the first contact part is formed so as to be curved or bent in a convex manner facing the contact piece in the inserted position of the memory card for grounding of the memory card.

7. The connector as claimed in claim 1, wherein the connection terminal for grounding has a single base part attached to the housing, and two intermediate parts arranged at spaced positions in the direction orthogonal to the longitudinal direction and extending from the base part in the longitudinal direction, and the first contact part and the second contact part are formed at ends of the intermediate parts, respectively.

8. The connector as claimed in claim 1, wherein the connection terminal for grounding is formed by two terminal forming members, one terminal forming member having a first base part attached to the housing and a first intermediate part extending from the first base part in a direction away from the mouth in the longitudinal direction, the first contact part being formed at an end of the first intermediate part, the other terminal forming member having a second base part attached to the housing at a position farther from the mouth than the first base part and a second intermediate part extending from the second base part toward the mouth in the longitudinal direction, and the second contact part being formed at an end of the second intermediate part.

9. The connector as claimed in claim 1, wherein the plurality of connection terminals are disposed so as to contact a plurality of respective contact pieces between a plurality of partition walls of the memory card in the inserted position, at least two connection terminals other than the connection terminal for grounding are disposed so as to contact a contact piece between the partition walls, one of the at least two connection terminals has a third contact part operable to contact the contact piece, the other of the at least two connection terminals has a fourth contact part operable to contact the contact piece and displaced toward the mouth in the longitudinal direction, and the first contact part is disposed between the third contact part and the fourth contact part in the longitudinal direction.

10. The connector as claimed in claim 1, wherein the connector is of a push-in push-out type in which, when the memory card is inserted into the housing, the memory card is pushed in to a back end position more distant from the mouth than a connection position in which the plurality of contact pieces are connected to the plurality of connection terminals, and then the memory card is released, the memory card is returned to the connection position and locked at the connection position, and when the memory card is pushed in to the back end position again and is then released, the memory card is set at an extraction position in which a part of the memory card projects from the mouth.

11. A combination of a memory card loaded in an inserted position into a connector, the combination comprising:

a memory card having a pair of adjacent partition walls and at least two contact pieces disposed between the pair of adjacent partition walls; and a connector having a housing for receiving the memory card in the inserted position, a mouth at one end of the housing for inserting the memory card into the housing and for removing the memory card from the housing, the insertion and removal being performed in a longitudinal direction of the housing, and two connection terminals at spaced positions in the longitudinal direction, the two connection terminals contacting respective ones of the contact pieces of the memory card in the inserted position, wherein each contact piece of the memory card has a length in the longitudinal direction such that the respective connection terminals does not go beyond the contact piece in the longitudinal direction when the memory card is in the inserted position;

the contact pieces being arranged so that they are in tandem along the longitudinal direction of the housing when the memory card is inserted in the housing.

* * * * *

UNITED STATES PATENT AND TRADEMARK OFFICE

CERTIFICATE OF CORRECTION

PATENT NO. : 7,281,951 B2
APPLICATION NO. : 11/286202
DATED : October 16, 2007
INVENTOR(S) : Yoshitaka Aoki It is certified that error appears in the above-identified patent and that said Letters Patent is hereby corrected as shown below:

**Column 16, line 21 claim 11, “terminals” should read --terminal--.

Signed and Sealed this

Eighteenth Day of November, 2008

JON W. DUDAS
*Director of the United States Patent and Trademark Office*